United States Patent [19]

Fukuchi et al.

[11] 3,950,815

[45] Apr. 20, 1976

[54] SUCTION PORT DEVICE FOR A VACUUM CLEANER

[75] Inventors: Akinori Fukuchi, Mito; Kazuo Kubota, Hitachi, both of Japan

[73] Assignee: Hitachi, Ltd., Japan

[22] Filed: Mar. 18, 1974

[21] Appl. No.: 452,271

[30] Foreign Application Priority Data

Mar. 28, 1973 Japan ..... 48-34575

[52] U.S. Cl. ..... 15/399; 15/418; 15/419

[51] Int. Cl.[2] ..... A47L 9/06

[58] Field of Search ..... 15/398, 399, 401, 415, 15/418, 419, 420

[56] References Cited

UNITED STATES PATENTS

| | | | |
|---|---|---|---|
| 1,301,319 | 4/1919 | Quam | 15/399 |
| 2,658,228 | 11/1953 | Meyerhoefer | 15/415 X |
| 3,550,183 | 12/1970 | Wolf | 15/421 X |

*Primary Examiner*—Stanley N. Gilreath
*Assistant Examiner*—C. K. Moore
*Attorney, Agent, or Firm*—Craig & Antonelli

[57] ABSTRACT

A suction port device comprising a shield member extending along at least one of the peripheral edges of an opening formed in a suction port body, so that the suction force of the vacuum cleaner can be made substantially uniform in intensity over the entire length of the suction port body.

18 Claims, 12 Drawing Figures

SUCTION PORT DEVICE FOR A VACUUM CLEANER

This invention relates to a suction port device used for vacuum cleaners for collecting dust and dirt through a filter by means of the suction force produced by a fan motor or the like.

In the prior art suction port devices of this type, it has hitherto been customary to provide brush, rollers or other buffer means on the lower surface or outer periphery of a suction port body in order to preclude damages to a surface of a hard material to be cleaned. When brush is used as a buffer means, it is necessary to provide a large gap between the suction surface (the lower surface of a carpet sled) and the surface to be cleaned because the brush may suffer wear and tear. On the other hand, when rollers are employed, the lower surface of the suction port body is open and the suction force at work on the suction surface is concentrated in the opening of the suction port body thereby making it impossible to render the entire length of the suction port body operable.

The prior art suction port devices have another disadvantage in that the amount of air flow passing through the suction port body is reduced in case the filter is partially obturated, with a result that almost no suction force is at work at opposite end portions of the suction port body. Thus, the surface from which dust and dirt is removed in each scanning stroke of the suction port body is very small in width compared with the length of the suction port body, thereby making cleaning a time consuming and labor wasting operation.

These disadvantages can be obviated by increasing the capacity of a fan motor used for a vacuum cleaner to increase the intensity of the suction force of the cleaner. However, considering the capacity of the power source in households in general, this is not a desirable solution. This is why there has been an increasing demand for a suction port device which can operate with a high efficiency without increasing the capacity of the fan motor now used for vacuum cleaners.

It is an object of the present invention to provide a suction port device for a vacuum cleaner in which the intensity of the suction force at work on the suction surface of a suction port body is rendered uniform at every point as much as possible so that the suction port body can exert a sufficiently high suction force to perform cleaning at every point between opposite end portions of the suction port body.

The aforementioned object of the present invention is accomplished by providing a shield member at the peripheral edges of the suction port body. The outstanding feature of the present invention is that the shield member is constructed such that the size of a gap formed between the lower ends of side walls of the shield member and the floor surface being cleaned can be made to vary in conformance with the intensity of the suction force at work in the suction port body so that the rate of air flow passing through the gap can be made substantially uniform at every point of the suction body.

Figure 1:
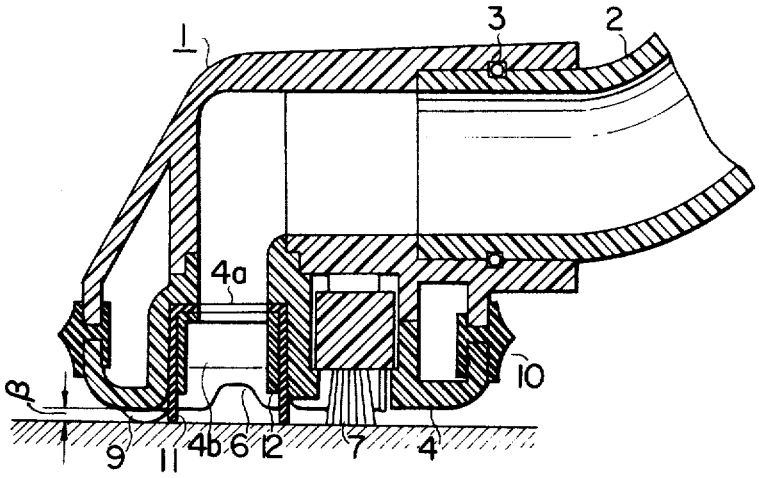
FIG. 1 is a vertical sectional view of the suction port device according to the present invention.
Figure 2:
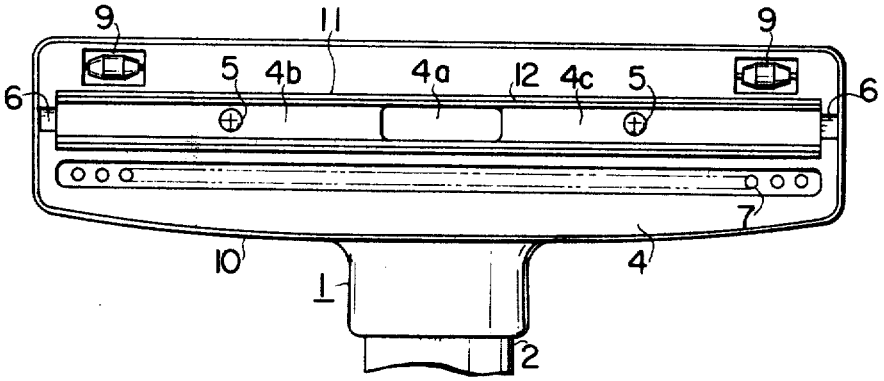
FIG. 2 is a bottom plan view of the suction port device shown in FIG. 1.
Figure 3:
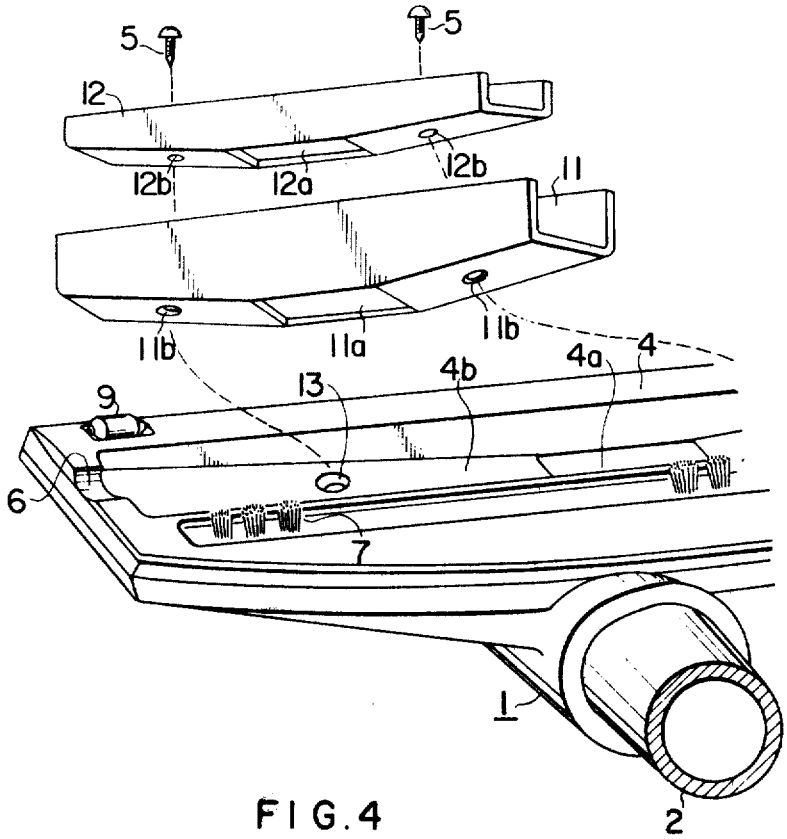
FIG. 3 is an exploded perspective view of the essential portions of the suction port device shown in FIG. 1.

The invention will now be described with reference to the drawings. There is shown in FIGS. 1 to 4 one embodiment in which the numeral 1 generally designates a suction port body to which a suction joint 2 is rotatably connected through a ring 3 adapted to preclude dislodging of the joint 2 from the suction port body 1. The numeral 4 designates a sled for carpet formed at its longitudinally central portion with an opening 4*a* for communication with the suction joint 2, and at opposite sides of the opening 4*a* with suction passageways 4*b* and 4 *c* each of which is substantially in the form of an inverted U-shaped groove. The sled 4 is attached to the underside of the suction port body 1 by means of screws 5, 5, each screw being disposed substantially at the central portion of each of the suction passageways 4*b* and 4*c*. The suction port body 1 is formed at opposite ends of its underside, with leak grooves 6, 6 each of which is in communication with each of the suction passageways 4*b* and 4*c* in the sled to keep the underside of the suction port body 1 from being pneumatically closed when cleaning carpet and the like.

The numeral 7 designates a brush disposed rearwardly of the opening 4*a* and suction passageways 4*b* and 4*c* and adapted to protrude or retire from the lower surface of the sled 4 by a plate spring. Rollers 9, 9 are provided forwardly of the suction passageways 4*b* and 4*c* and adapted to cooperate with the brush 7 to position the suction port body 1 so that the lower surface of the sled 4 can be kept from contacting with and damaging the floor surface during cleaning operation. The numeral 10 designates a buffer member attached to the entire outer periphery of the suction port body 1 and the numeral 11 a shield member substantially in the shape of inverted U in cross-section adapted to be fitted in the suction passageways 4*b* and 4*c* in intimate contact with the upper and side walls thereof. The shield member 11, which is made of a flexible material such as rubber, is formed at its upper wall with an opening 11*a* for communication with the opening 4*a*. The shield member 11 is also formed at its upper wall with holes 11*b*, 11*b* through which the screws 5, 5 extend to secure the shield member 11 to the sled 4 and thus to the suction port body 1.

The numeral 12 is a mounting member substantially in the shape of inverted U in cross-section for mounting the shield member 11 in the suction port body 1. By threadedly attaching the screws 5, 5 through holes 12*b* formed in an upper wall of the mounting plate 12 and holes 11*b*, 11*b* formed in the upper wall of the shield member 11 to the sled 4 while fitting the mounting member 12 in the member 11 in intimate contact relation with the upper and side walls thereof, the shield member 11 can be firmly affixed to the suction port body 1. Here, the numeral 12*a* is an opening formed in the upper wall of the mounting member 12 for communication with the opening 4*a*. The suction passageways 4*b* and 4*c* are each provided therein with a hole 13 for affixing the sled 4 to the suction port body 1 by the screws 5.

Figure 4:
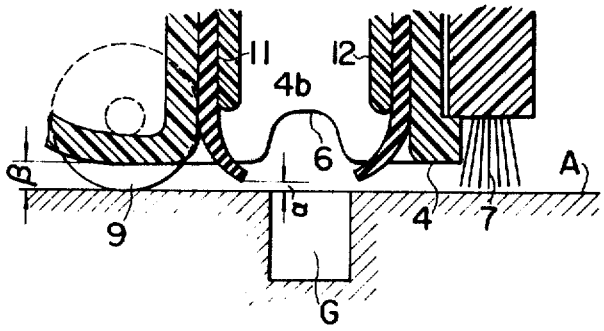
FIG. 4 is a sectional view, on an enlarged scale, of the essential portions of the suction port device of FIG. 1, being shown at work in cleaning operation.

The shield member 11 is constructed such that, when the suction port body 1 is placed on a floor surface A to be cleaned, the lower ends of the side walls of the shield member 11 may come into engagement with the floor surface A or a small gap may be provided between the lower ends of the shield member 11 and the floor surface A. In case the lower ends of the shield member 11 are in contact with the floor surface A, the suction force causes the lower end portions of the side walls of the shield member to be deformed to produce a very small gap $\alpha$ between them and the floor surface A as shown in FIG. 4 which gap $\alpha$ is smaller than a gap $\beta$ formed between the lower surface of the sled 4 and the floor surface A.

The suction port device constructed as aforementioned is connected to a main body of the cleaner as by flexible hose. By moving the suction body 1 with its lower surface contacting with the floor surface A to be cleaned, it is possible to suck in dust and dirt from the floor surface A through the opening 4a and the suction passageways **4*b* and 4*c*** into the cleaner.

Figure 12:
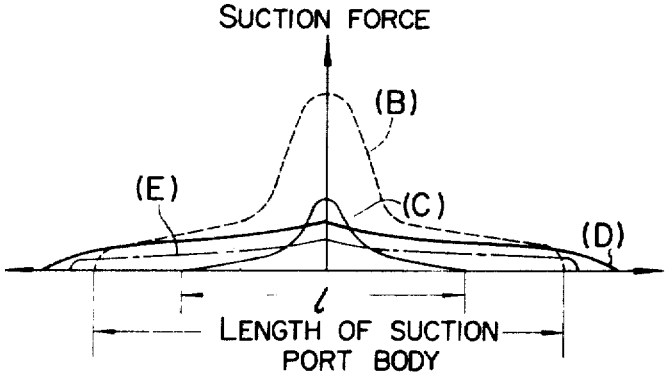
FIG. 12 is a graph showing suction force characteristics of various suction port devices.

Experiments were carried out for comparing the suction force of a vacuum cleaner provided with the suction port device constructed as aforementioned according to the invention with that of a vacuum cleaner equipped with a suction port device of the prior art. FIG. 12 shows the function characteristics of these vacuum cleaners in which abscissa is taken along the length of the suction port body 1 in the longitudinal direction and the intensity of the suction force is represented along ordinate. It will be seen from FIG. 12 that the suction force characteristics of the vacuum cleaner having a suction port device provided with no shield member 11 are such that the suction force distribution is as represented by curves (B) and (C) in the figure. When the filter is not obtained, the suction force is distributed substantially over the entire length of the suction port body as shown by the curve (B). However, when the filter is obturated to some extent, the suction force does not work at opposite end portions of the body as shown by the curve (C). This renders the effective length of the suction port body down to *l* as shown in the figure. Thus, the efficiency of cleaning is greatly reduced and, in addition, cleaning as of corner portions of floors becomes impossible.

However, according to the invention, the provision of shield member 11 reduces the amount of the gap $\beta$ between the suction port body 1 and the floor surface A to be cleaned as compared with the case of conventional vacuum cleaners, so that the negative pressure developed at the opening **4*a* becomes substantially equal to that developed at the suction passageways 4*b* and 4*c*. Thus, the suction force distribution is substantially uniform over the entire length of the suction port body as shown by a curve (D) in FIG. 12. The curve (D) shows that the suction force works not only on a portion of the floor surface disposed under the suction port means 1 but also on portions thereof which are disposed on both sides of the opposite ends of the suction port body 1. When the suction force is high in intensity, the negative pressure developed at the opening 4*a* and the suction passageways 4*b* and 4*c* acts such that lower end portions of the side walls of the shield member 11 are forced to bend inwardly toward each other as shown in FIG. 4, so that the gap $\alpha$ between the floor surface A and the suction surface is kept at a proper level and the dust and dirt below the suction port body 1** can be sucked into the cleaner by a very high suction force.

On the other hand, if the filter is partially obturated and the amount of air flow is decreased, then the negative pressure developed at the opening **4*a* is increased. This permits the lower end portions of the shield member 11 to be restored by their own resilience to their original shape as shown in FIG. 1, with a result that the gap between the floor surface A and the suction surface is reduced. Accordingly, the rate at which air flow passes through the gap is increased. When this is the case, the suction force characteristics of the vacuum cleaner are such that the suction force is distributed as shown by a curve (E) in FIG. 12.** Thus, it will be seen that, although the suction force as a whole is reduced in intensity below that shown by the curve (D), the suction force can be maintained sufficient for the purpose of cleaning over all the portions of the suction port body.

In order to evaluate the suction force with the suction port device according to the invention, experiments were carried out in which sand of a particle size of 250 mesh was spread evenly up to a thickness of 1 millimeter on a boarded floor and then removed by the vacuum cleaner with a suction port body 1 of a length of 300 millimeters. The operation of sucking sand lasted for three seconds, and the ratio of the length of a portion of the suction port body 1, which actually sucks sand, to the entire length of the body 1 were 100 % when the amount of air flow was 1.4 $m^3$/min. and 50 % when the amount of the air flow was 0.6 $m^3$/min. with a conventional suction port body provided with no shield member.

However, the ratio was 100 % even when the amount of air flow was 0.6 $m^3$/min. with a suction port body provided with the shield member according to the invention, which shows that the suction port body according to the present invention effectively functions. That is, when the amount of air flow is 0.6 $m^3$/min., the filter is considerably obturated and the dust case is substantially filled with dust and dirt. Thus, it has been shown that the provision of a shield member is effective to maintain the intensity of the suction force at a high level even under such conditions.

It has also been ascertained that, since the suction opening of the suction port body 1 is contracted by inward bending of the lower end portions of the shield member 11, the suction force is increased in intensity and a vortex flow is caused to occur at the floor surface being cleaned by reason of the vibration of the lower end portions of the shield member 11, thus, permitting dust and dirt even in a recess G on the floor surface being cleaned as shown in FIG. 4 to be readily removed.

Figure 5:
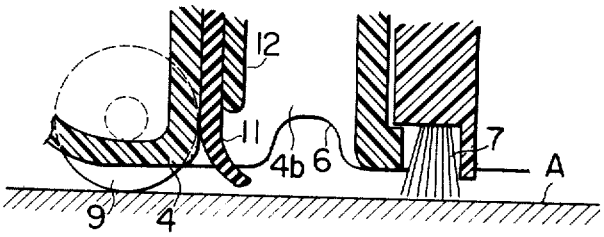
FIGS. 5 to 11 are sectional views of the essential portions of other embodiments of the invention.

FIG. 5 shows another embodiment of the invention in which a mounting member 12 and a shield member 11 respectively are substantially in the shape of inverted L, with a side wall of the shield member 11 being disposed only in front of an opening **4*a* and suction passageways 4*b* and 4*c*. Even though the shield member 11** has only one side wall, it is possible to maintain the intensity of the suction force at opposite end portions of the suction body at a higher level than with no shield member.

Figure 6:
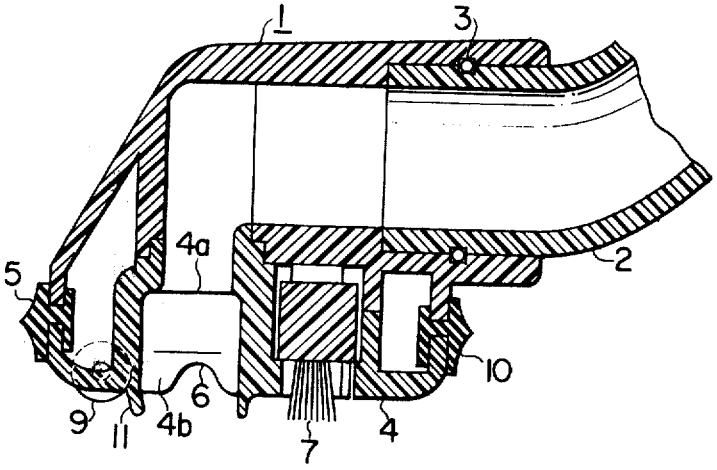

FIG. 6 shows another embodiment in which a shield member 11 is formed integrally with a sled 4 for carpet. This arrangement eliminates the need to use a mounting member 12. It suffices to make the sled 4 of a soft synthetic resinous material in order that the shield member 11 is sufficiently flexible.

Figure 7:
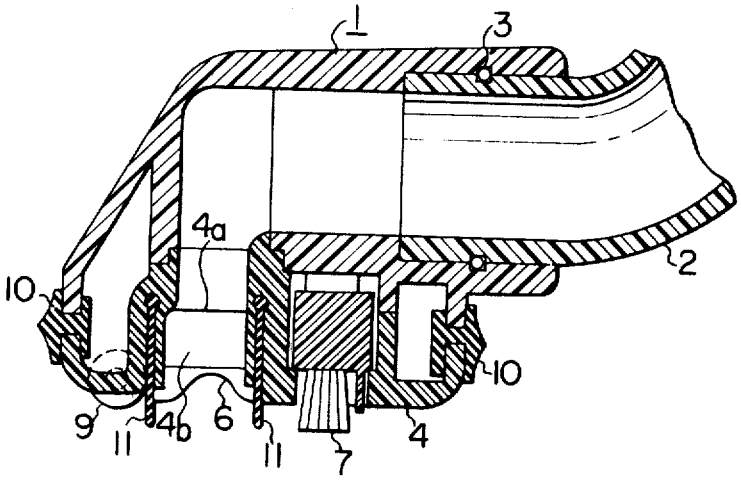

FIG. 7 shows another embodiment in which there is provided no mounting plate 12 and a shield member 11 is directly embedded in a sled 4 for carpet. In this embodiment, the shield member 11 consists of two rectangular plates, so that a mounting member can be omitted.

Figure 8:
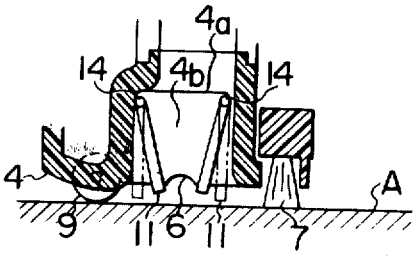

In another embodiment shown in FIG. 8, a shield member consists of two rectangular plates each pivotally supported at an upper end by a pin 14 and disposed in the suction passageways 4*b* and 4*c*. The two rectangular plates are normally resiliently urged as by helical springs or the like (not shown), into the position shown by dash-and-dot line in FIG. 8, in which the rectangular plates 11 are disposed substantially upright. However, when the negative pressure developed at the opening 4*a* is increased, the lower ends of the shield member 11 moved inwardly toward each other against the biasing force of the springs, thereby increasing the size of the gap between the lower ends of the shield member 11 and the floor surface being cleaned. In other words, the lower ends of the shield member 11 move inwardly toward each other when the amount of the air flow passing through the opening 4*a* is increased, thereby increasing the size of the gap between the lower ends thereof and the floor surface being cleaned; the lower ends of the shield member 11 move away from each other in the positions shown by the dash-and-dot lines in FIG. 8, when the amount of air flow is reduced, thereby reducing the size of the gap between the lower ends thereof and the floor surface being cleaned. In this respect, the rate at which air flow passes through the gap is substantially constant regardless of the amount of air flow, so that the performance of the suction port body 1 can be maintained at a high level in cleaning operation.

Figure 9:
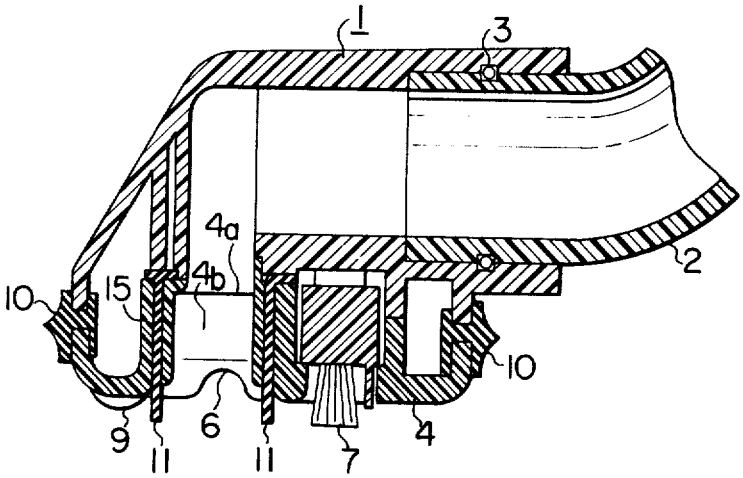

In FIG. 9, there is shown still another embodiment in which a shield member 11 substantially in the shape of plates projects outwardly through grooves 15 formed in a sled 4 for carpet beyond the lower surface thereof and is held between the suction port body 1 and the sled 4. A mounting member 12 can be omitted.

Figure 10:
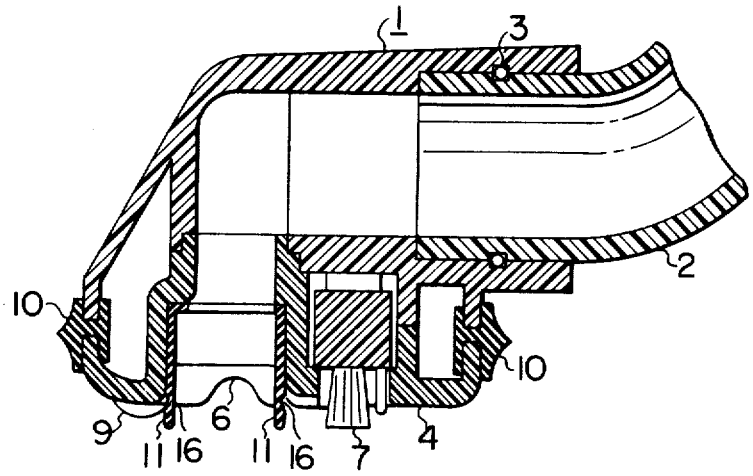

FIG. 10 shows still another embodiment in which side walls of a shield member 11 substantially in the shape of inverted U are each formed at the outer surface thereof with a notch 16. The provision of the notches 16 permits the side walls of the shield member 11 to be readily deformed in conformance with the suction force. This holds in case the shield member 11 is formed integrally with the sled 4.

Figure 11:
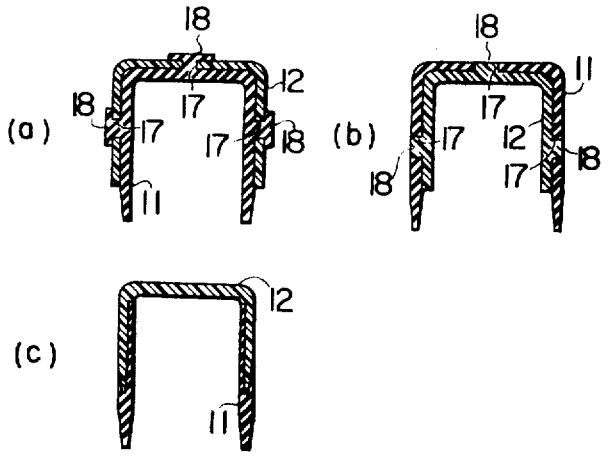

In FIG. 11, there are shown various forms of a shield member 11. In FIG. 11*a*, there is shown one of the forms in which a plurality of holes 17 are formed in the upper and side walls of a mounting member 12 each for fitting therein a projection formed on the upper and side walls of a shield member 11, thereby facilitating mounting the shield member 11 in the suction passageways 4*b*, 4*c*. FIG. 11 *b* shows another form in which projections 18 are formed in the mounting member 12 and holes 17 are formed in the shield member 11. FIG. 11 *c* shows still another form in which a plate made of a soft synthetic resinous material is affixed to the lower end portion of each side wall of the mounting member 12 so that the resin plates may serve as the shield member 11. Mounting of the shield member in the suction port body can be facilitated and more readily performed when the forms shown in FIGS. 11 *a* to 11 *c* are employed than when the forms shown in FIGS. 1 to 4 is used.

In all the embodiments shown in FIGS. 1 to 11 inclusive, the rollers 9 are mounted forwardly of the shield member 11 and the brush 7 is arranged rearwardly thereof. The brush 7 can be arranged forwardly of the shield member 11 while omitting the rollers 9.

From the foregoing description, it will be appreciated that, taking into consideration that the function of shield member 11 is to reduce the size of the gap between the suction opening surface and the floor surface being cleaned when the amount of air flow is decreased, the shield member 11 may be such that the member 11 is slidably supported inside the sled 4 for up and down movement so as to vary the size of the gap between the lower ends of the shield member 11 and the floor surface being cleaned in conformance with the negative pressure developed at the opening 4*a*.

In order that the side walls of the shield member may be evenly bended inwardly toward each other by the suction pressure, the wall thickness of the shield member can be varied such that the thickness of a portion of each side wall adjacent the opening in the suction port body 1 is maximized and that of each side wall away from the opening toward the opposite end portions of the body is increasingly reduced. This arrangement permits the intensity of the suction force to be distributed uniformly over the entire length of the suction port body 1. By constructing the shield member such that the front side wall is slightly inclined inwardly, it is possible to permit dust and dirt in front of the suction port body 1 to be readily sucked through the opening 4*a*.

As described above the present invention has many advantages. The provision of the shield member can have a suction force of sufficiently high intensity over the entire length of the suction port body, even when the filter of the cleaner is partially obturated and the amount of air flow introduced into the cleaner is reduced. This results in increased efficiency of cleaning and permits dust and dirt in corners of floors to be completely removed. Additional advantages reside in that the present invention can perform cleaning with increased efficiency with less electric power and noise because it is not necessary to increase the capacity of the fan motor.

We claim:

1. A suction port device for a vacuum cleaner comprising:

a suction port body having a suction pressure opening and dust accepting opening means spaced from said suction pressure opening for accepting dust and dirt from a surface being cleaned in response to suction pressure applied at the suction pressure opening, and suction adjusting shield member means disposed along at least one peripheral edge of said dust accepting opening means for forming an air gap with the surface being cleaned, wherein said shield member means are disposed and configured such as to allow the size of said air gap to vary as a function of the air flow rate through said air gap.

2. A suction port device as claimed in claim 1, further comprising a brush disposed rearwardly of said dust accepting opening means, said shield member means being disposed forwardly of said opening means.

3. A suction port device according to claim 1 wherein said shield member means includes a shield member made of flexible material so that the lower end of said shield member is adapted to bend inwardly in the direction of said dust accepting opening means in response to the suction pressure.

4. A suction port device as claimed in claim 3, further comprising a carpet sled attached to said suction port body and formed with an opening at its central portion and with suction passageways in the form of grooves disposed oppositely lengthwise of said opening, said shield member being directly embedded in said carpet sled.

5. A suction port device as claimed in claim 3, further comprising a carpet sled attached to said suction port body and formed with an opening at its central portion and with suction passageways in the form of grooves disposed oppositely lengthwise of said opening, and a mounting member being of the same cross-sectional shape as said grooves and fitted in said grooves, said shield member being affixed to said suction port means through said mounting member.

6. A suction port device as claimed in claim 3, further comprising a carpet sled attached to said suction port body and formed with an opening at its central portion and with suction passageways in the form of grooves disposed oppositely lengthwise of said opening, said shield member being in the shape of a substantially inverted U and being mounted in the suction passageways by means of a mounting plate in the shape of a substantially inverted U.

7. A suction port device according to claim 1 wherein said shield member means are disposed and configured such as to allow the size of said air gap to be reduced when the air flow rate through said air gap is decreased.

8. A suction port device according to claim 1 wherein said dust accepting opening means includes a long narrow opening, wherein said shield member means includes a shield member disposed along at least one long edge of said long narrow opening, and wherein said shield member is made of flexible material so that the lower end of said shield member is adapted to bend inwardly in the direction of said long narrow opening in response to said suction pressure.

9. A suction port device according to claim 8 wherein said shield member is integrally formed with said suction port body.

10. A suction port device according to claim 1 wherein said dust accepting opening means includes a long narrow opening, wherein said shield member means includes a pair of shield members disposed one each along respective opposite long edges of said long narrow opening, and wherein said shield members are made of flexible material so that lower ends thereof are adapted to bend inwardly into said long narrow opening in response to suction pressure.

11. A suction port device according to claim 10 wherein said shield members are pivotally supported at their upper ends to said suction port body.

12. A suction port device according to claim 10 wherein said shield members are supported in grooves provided in a carpet sled attached underneath said suction port body.

13. A suction port device for a vacuum cleaner comprising a suction port body having a suction joint for connecting said suction port body to a device for applying suction pressure, a carpet sled mounted on the underside of said suction port body and provided with an opening for introducing dust and dirt sucked from a surface being cleaned into said suction joint and with suction passageways in the form of grooves disposed oppositely lengthwise of said opening, means for maintaining a gap ($\beta$) at a predetermined level between the carpet sled and the surface being cleaned, and a suction adjusting member for forming a gap ($\alpha$) of a smaller size than that of said gap ($\beta$) along the edges of the opening and suction passageways and between the suction adjusting member and the surface being cleaned, said gap ($\alpha$) formed between the surface being cleaned and the suction adjusting member being adapted to be reduced in size as the air flow rate through said suction port means is decreased.

14. A suction port device as claimed in claim 13 wherein said suction adjusting member is made of a flexible material, so that said lower ends of said suction adjusting member are adapted to bend inwardly into the opening of the carpet sled and the suction passageways when the air flow rate through said suction port body is at more than a certain level, and, in addition, said lower ends of said suction adjusting member are adapted to bend less as the air flow rate through said suction port body is decreased.

15. A suction port device as claimed in claim 13 further comprising a mounting member adapted to be fitted in the suction passageways of the carpet sled, said suction adjusting member being secured to the underside of the carpet sled by inserting said suction adjusting member between the mounting member and the suction passageways.

16. A suction port device as claimed in claim 15 further comprising means for securing said carpet sled to said suction port body and characterized in that said suction adjusting member and said mounting member are secured to the carpet sled through said securing means.

17. A suction port device as claimed in claim 15, characterized in that said mounting member and suction adjusting member respectively are in the shape of inverted U in cross-section.

18. A suction port device for a vacuum cleaner comprising a suction port body having a suction joint for connecting said suction port body to a device for applying suction pressure, a carpet sled mounted on the underside of said suction port body and provided with an opening for introducing dust and dirt sucked from a surface being cleaned into said suction joint and with suction passageway in the form of grooves disposed oppositely lengthwise of said opening, brush means provided rearwardly on the underside of said suction port body, a plurality of rollers provided forwardly on the underside of said carpet sled for balancedly cooperating with said brush means so as to maintain a gap ($\beta$) at a predetermined level between the underside of said carpet sled and the surface being cleaned, and a suction adjusting member made of a flexible material for forming a gap ($\alpha$) of a smaller size than that of said gap ($\beta$) along the edges of the opening and suction passageways and between the suction adjusting member and the surface being cleaned, said suction adjusting member being constructed such that said gap ($\alpha$) is reduced in size as the air flow rate through said suction port body is decreased.

* * * * *